US009921014B2

(12) United States Patent
Dees

(10) Patent No.: US 9,921,014 B2
(45) Date of Patent: Mar. 20, 2018

(54) PISTOL WITH HORIZONTAL MAGAZINE BENEATH THE BARREL

(71) Applicant: John Dees, Germantown, MD (US)

(72) Inventor: John Dees, Germantown, MD (US)

( * ) Notice: Subject to any disclaimer, the term of this patent is extended or adjusted under 35 U.S.C. 154(b) by 0 days.

(21) Appl. No.: 15/471,757

(22) Filed: Mar. 28, 2017

(65) Prior Publication Data

US 2017/0299296 A1 Oct. 19, 2017

Related U.S. Application Data

(60) Provisional application No. 62/390,392, filed on Mar. 28, 2016.

(51) Int. Cl.

| | |
|---|---|
| ***F41A 9/61*** | (2006.01) |
| ***F41A 9/69*** | (2006.01) |
| ***F41A 9/70*** | (2006.01) |
| ***F41C 3/00*** | (2006.01) |

(52) U.S. Cl.
CPC *F41A 9/69* (2013.01); *F41A 9/70* (2013.01); *F41C 3/00* (2013.01)

(58) Field of Classification Search
CPC ..... F41C 3/00
USPC ..... 42/6, 49.01, 50, 17
See application file for complete search history.

(56) References Cited

U.S. PATENT DOCUMENTS

| | | | | |
|---|---|---|---|---|
| 2,130,722 A * | 9/1938 | Kobe | F41A 9/73 | 42/19 |
| 4,905,394 A | 3/1990 | Predazzer | 42/17 | |
| 5,517,896 A * | 5/1996 | Perrine | F41A 3/50 | 42/25 |
| 9,453,702 B2 * | 9/2016 | Bruhns | F41C 23/10 | |
| 9,568,264 B2 * | 2/2017 | Graves | F41A 17/46 | |

OTHER PUBLICATIONS

Walther P38 9mm Auto Pistol Owner Instruction & Safety Manual, Quentin/RQS, Sep. 11, 2011, pp. 1-16.

* cited by examiner

*Primary Examiner* — John W Eldred
(74) *Attorney, Agent, or Firm* — Stein IP, LLP

(57) ABSTRACT

A striker fired semi-automatic pistol or handgun that utilizes a magazine positioned horizontally and in front of the grip. The pistol of the invention includes two recoil springs and two locking lugs positioned on each side of the barrel (1 per side) which has a corresponding set of locking blocks. A sliding stripper rail is utilized to move cartridges from the magazine to the barrel. The grip is detachable and completely customizable, using a small solid tang to connect the grip to the firearm.

23 Claims, 16 Drawing Sheets

PISTOL WITH HORIZONTAL MAGAZINE BENEATH THE BARREL

BACKGROUND OF THE INVENTION

1. Field of the Invention

This invention relates generally to the field of firearms, and more specifically to a new design for a semiautomatic pistol.

2. Description of the Related Art

Semiautomatic handguns are well documented in the art. They are called semiautomatics because the action of firing the pistol loads a new cartridge into the chamber where it can be fired with another pull of the trigger. On most models this is accomplished by the recoil of the fired round forcing the slide to the rear, which ejects the spent casing by use of the extractor, and then sweeps a new cartridge from the magazine into place when the slide is brought back forward by the recoil spring. Typically, commercially available semiautomatic handguns feed cartridges from a magazine located in the grip.

The firing mechanism of a semiautomatic pistol can be divided into two main categories: hammer fired and striker fired. Hammer fired devices use a hammer, moved by the pull of the trigger, which strikes the firing pin, which in turn strikes the primer of the chambered cartridge and ignites the gunpowder contained therein, causing the device to discharge.

Striker fired handguns combine the hammer and firing pin into one piece, called the striker, which is released, and usually partially cocked, by moving the trigger and then reset into a loaded position by the pistol slide cycling.

When a round is discharged, the slide assembly is moved backwards by recoil until the locking lug at the base of the barrel comes into contact with the ramped surface of the locking block, forcing the barrel to tilt and stay in place while the slide recoils fully.

A slide stop is typically used to keep the slide in place on modern pistols, especially striker fired pistols. The slide lock is a piece of metal that contours with the front portion of the locking lug, preventing the slide from going forward beyond a certain point. It is typically attached to a spring that exerts upwards pressure and must be depressed before disassembly.

A slide lock is a mechanism that locks the slide in a rearward position. This is achieved by the contours of an empty magazine exerting upwards pressure on the slide lock bar, due to the position and shape of the floorplate, which moves the slide lock lever into an indentation when the slide is cycled towards the rear and prevents the slide from cycling forward. Alternatively, the slide can be locked in a rearward position by the operator manipulating the slide and slide lock lever manually.

Most semiautomatic pistols have non-chambered cartridges contained inside a magazine which is placed and locked into the magazine well. The magazine well is almost universally located in the grip of the gun. When desired, the magazine can be ejected by pressing the magazine release button. Most magazines are angled to match the grip of the firearm and push the cartridge upwards with a spring and floor plate, which brings them in place for loading. The magazine interacts with the magazine latch system through notches cut into the magazine in these designs.

Safeties on handguns come in a variety of forms. Hammer fired pistols usually have a manual safety which must be manually moved to a 'fire' position by the operator. Less common are grip safeties, which are located on the grip and must be depressed by the hand before the firearm will operate. On striker fired handguns the safeties are usually completely internal, although external safeties like those usually seen on a hammer fired model may be present. The forms of these safeties are varied but nearly all striker fired handguns possess a trigger safety, which is located on the face of the trigger and must be depressed before the trigger can be moved back enough to cause a discharge. Nearly all striker fired handguns also possess a firing pin block safety, which will provide a barrier between the firing pin and a chambered cartridge's primer that is moved out of the way by the movement of the trigger.

Both hammer and striker fired guns may feature a magazine disconnect safety which will not allow the device to fire when a magazine is not in place. This is accomplished by either providing a barrier between the firing pin or striker and the primer of the chamber cartridge which is moved aside when a magazine is present or by moving the firing mechanism out of battery when a magazine is absent, the latter being more common.

Existing handguns are deficient in part because the position of the magazine located within the grip causes muzzle flip when the gun is fired due to a rearward point of balance. This results in less tactile feedback and an unwanted amount of recoil.

Existing handguns also have limited ammunition capacity and constraints with respect to customizable grips partly due to the limitations imposed on the gun by having to locate the magazine within the grip.

Accordingly, an object of the invention is to provide a handgun in which the magazine is located in front of the grip, providing the gun greater tactile feedback with respect to the muzzle position and reducing muzzle flip when the gun is fired. This also provides greater freedom in increasing ammunition capacity and customizing the grips. Other objects will also be apparent from the detailed description of the invention.

SUMMARY OF THE PRESENT INVENTION

Broadly stated, the objects of the invention are realized, according to one aspect of the invention, by providing a new handgun or pistol design that reduces muzzle flip by moving the magazine in front of the grip and below the barrel. In addition, this new design provides many useful and unexpected benefits, such as allowing for an expanded ammunition capacity and providing more opportunities for customizing the grips.

In one embodiment, the present invention is a striker fired pistol with a magazine well that places a magazine horizontally into a position forward of the hand and beneath the barrel. The magazine has an internal helix which turns the cartridge at the mouth of the magazine so that it is facing towards the front of the firearm when the magazine is in place. The cartridges not ready to feed are located perpendicular to the barrel or inside the helix but below the magazine mouth. The magazine utilizes two 'pushers' in addition to springs to make the cartridges feed properly up the helix. The helix end is rounded and the bottom section of this end is where the magazine well lock interacts with the magazine release. The magazine has two small hooks on the end near the muzzle which insert themselves into indentations in the frame to provide support to the magazine.

Additionally, the magazine latch extension is a solid piece of material located beneath the mouth of the magazine, which provides a stronger lock than standard notches in the magazine.

In an embodiment of the invention, the magazine well is open, save for a small crescent to guide the circular end of the magazine into place, making replacing the magazine much easier and more instinctive, especially under stress.

In an embodiment of the invention, the feeding mechanism utilizes a sliding stripper rail. The stripper rail will be moved into a downward position when the slide cycles rearwards and then back into an upwards (and out of the way) position when the slide moves forward by contact with the barrel. The stripper rail contacts the cartridge at the top of the magazine and guides it into the chamber. The sliding stripper rail slides upwards so that it does not interfere with the magazine well or the magazine.

In an embodiment of the invention, the barrel utilizes a 'winged' design which means that the locking lugs are located on both sides of the barrel. The locking block is correspondingly divided into two sections and placed appropriately.

Two recoil springs and guide rods may be used in conjunction with the winged magazine and are located to either side of the barrel.

In an embodiment of the invention, the slide stop is located forward of the barrel chamber and interacts with locking lugs on either side of the barrel. The slide stop lever is located in the frame. The stop does not extend out the side as is typical in standard designs, and the magazine must be removed before it can be manipulated.

The slide lock is engaged when the pushers come to their final position and the floorplate is in its closest position to the mouth of the magazine after the magazine has been emptied, the floorplate extension asserting upwards pressure on the slide lock bar to bring the slide lock lever into place. The slide lock lever can be used to manually engage or release the lock.

In an embodiment of the invention, a sliding style trigger is utilized in place of the more common pivoting trigger.

The safeties that may be used include but are not limited to a striker fire trigger safety, a magazine disconnect safety, a firing pin block safety (e.g., angled to match the angle of the sliding trigger), and a slide disconnect safety so that when the slide is out of battery the firing mechanism will not be able to engage the striker. More specifically, the magazine disconnect safety will move horizontally with the magazine and, when there is no magazine in place, block the firing mechanism from engaging the striker. It will also aid in ejecting the magazine from the magazine well.

In an embodiment of the invention, the grip may be completely detachable and in one solid piece, separate and independent from the rest of the firearm that attaches to a small, solid tang. This also allows an internal battery and integral electronics (e.g., lights, lasers, microphones, cameras) to be built into the grip. It also allows an accessory rail or other customization to be built into the bottom of the grip, due to the lack of magazine well in the grip.

BRIEF DESCRIPTION OF DRAWINGS

The invention is more fully described by reference to the following detailed description and the accompanying drawings wherein.

DETAILED DESCRIPTION OF THE INVENTION

Figure 1:
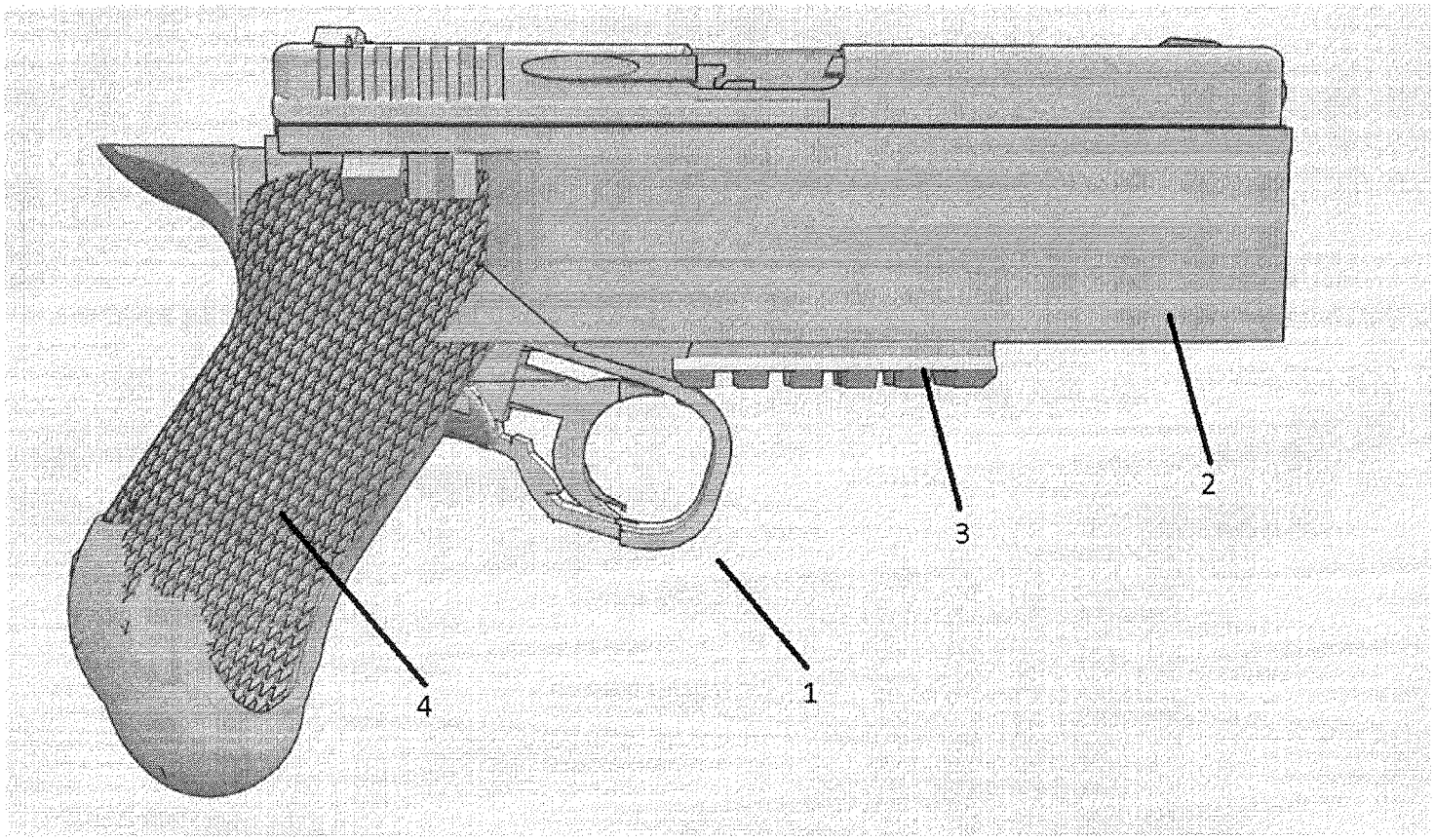
FIG. 1 is a side view of an exemplary embodiment of the pistol in an assembled state with the magazine in place, the grip attached and the slide forward.

Referring more specifically to the drawings, FIG. 1 is a side view of an exemplary embodiment showing the pistol of the invention in an assembled state 1. This is the form in which the newly designed pistol would normally be carried and discharged.

Figure 2:
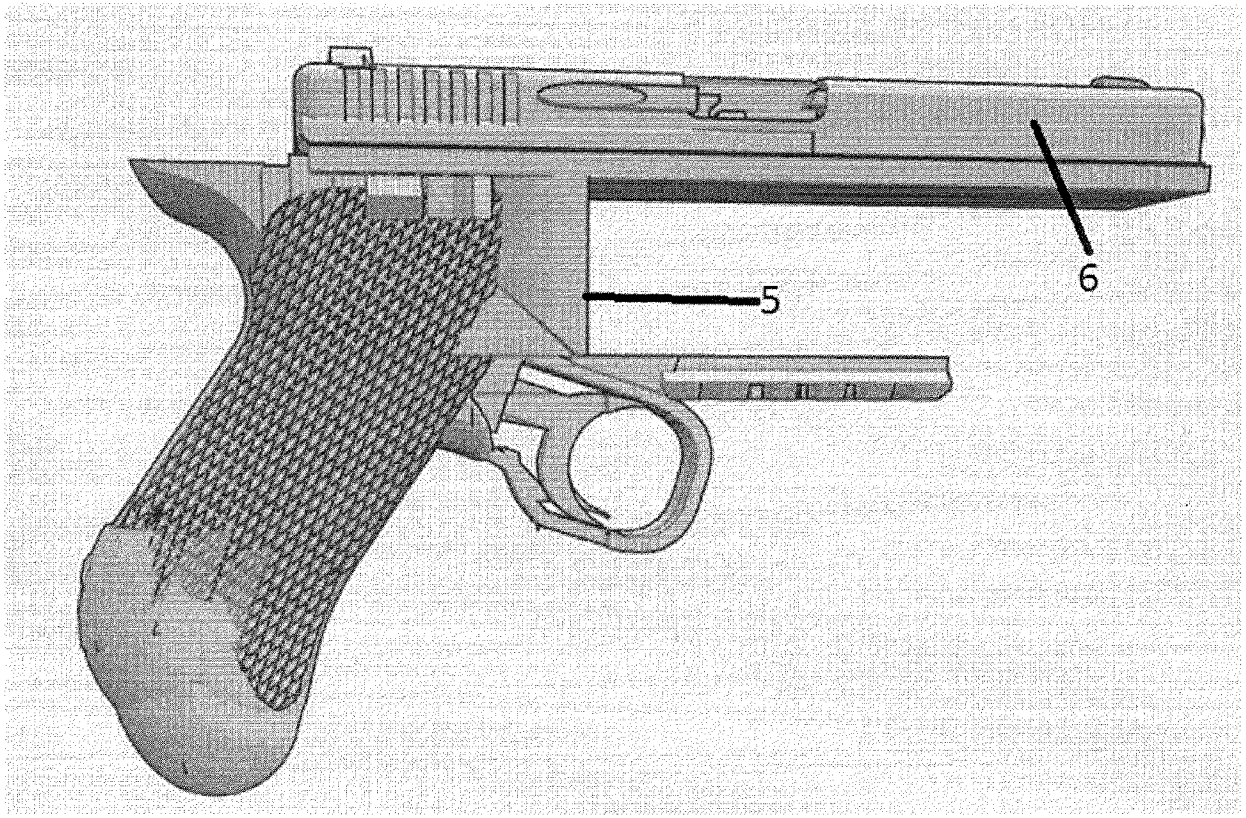
FIG. 2 is a side view of the pistol of the invention showing the magazine detached from the magazine well.

FIG. 2 is an embodiment showing the firearm without a magazine 2 in the magazine well 5. This embodiment also shows the slide 6. The position of the magazine well is unlike standard semi-automatic handguns. It is an open design for quicker and easier loading, the magazine located forward of the grip and positioned horizontally. In this embodiment, the magazine well 5 comprises a crescent shaped wall above the trigger guard and below the barrel that contains the magazine locking mechanism. Additional support for the magazine is provided by the two magazine support hooks 11 on the muzzle end of the magazine entering hollowed out areas in the front of the frame of the firearm. This position of the magazine moves the balance of the firearm forward, providing the gun greater tactile feedback with regards to the muzzle position as well as reducing muzzle flip when the gun is fired. Because the magazine well is open and rounded it is much easier to use, especially under stress, and the crescent shape guides the magazine into place if the magazine is anywhere near the correct position. This is much easier than angling a standard design magazine into the grip. In an embodiment of the invention, an accessory rail 3 may be attached to the frame of the firearm or detached as the user prefers.

Figure 3:
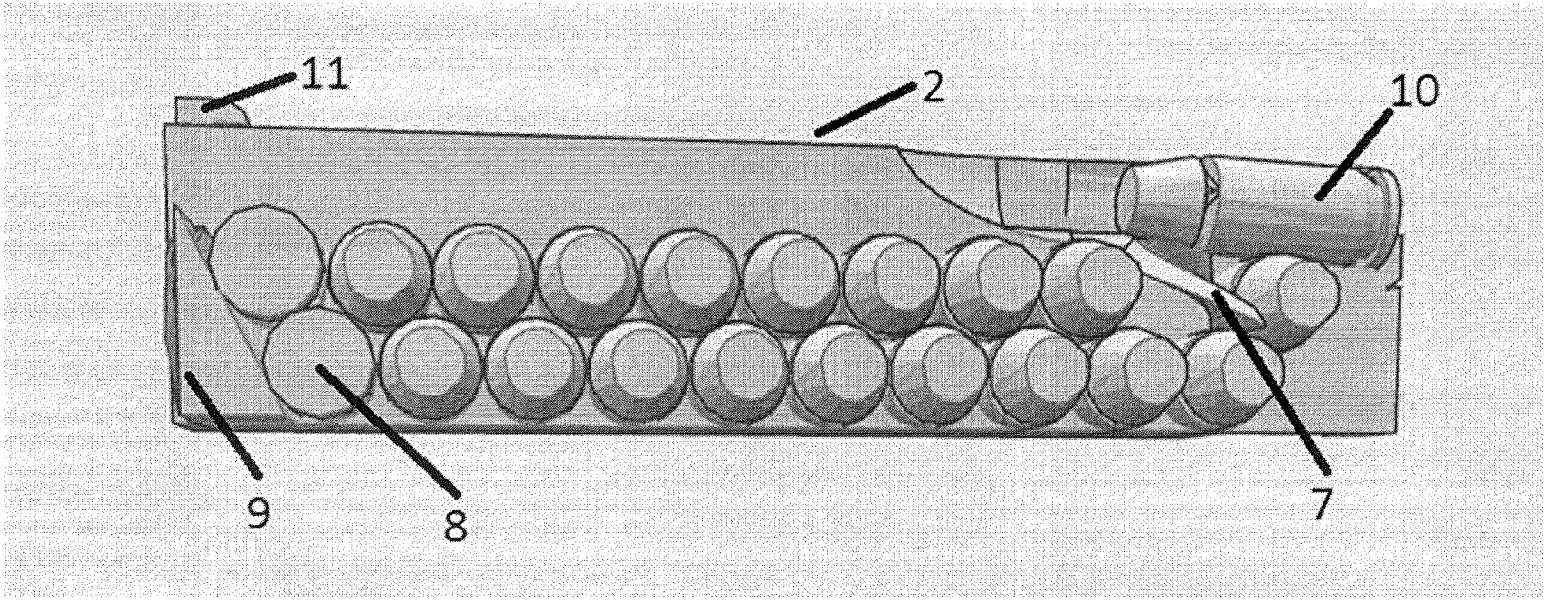
FIG. 3 is a left side view showing the internal aspects of a fully loaded magazine.
Figure 4:
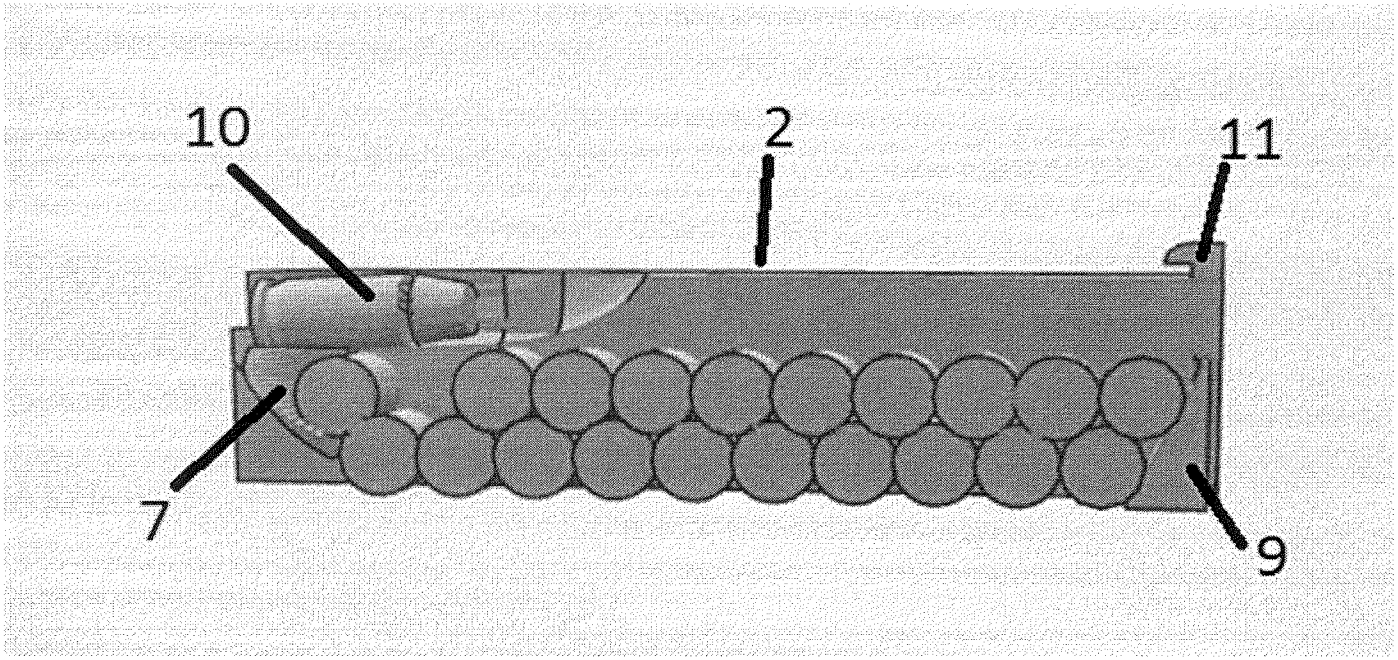
FIG. 4 is a right side view showing the internal aspects of a fully loaded magazine.

FIG. 3 and FIG. 4 show embodiments of the magazine 2 fully loaded and from different sides. The cartridge 10 at the mouth of the magazine faces towards the muzzle and is in line with the barrel. This position is achieved by the use of an internal helix and two 'pushers' located inside the magazine. FIGS. 3 and 4 show the two halves of the helix 7 which turns a cartridge 90 degrees. When the magazine is empty a pusher 8 is forced up to the mouth of the magazine and halted at a 45° angle when viewed from above due to its shape. The design of the magazine allows a significantly greater number of cartridges to be stored in the magazine compared to other handguns of similar size. The magazine and the frame may be contoured to each engage with each other to aid in loading.

Figure 5:
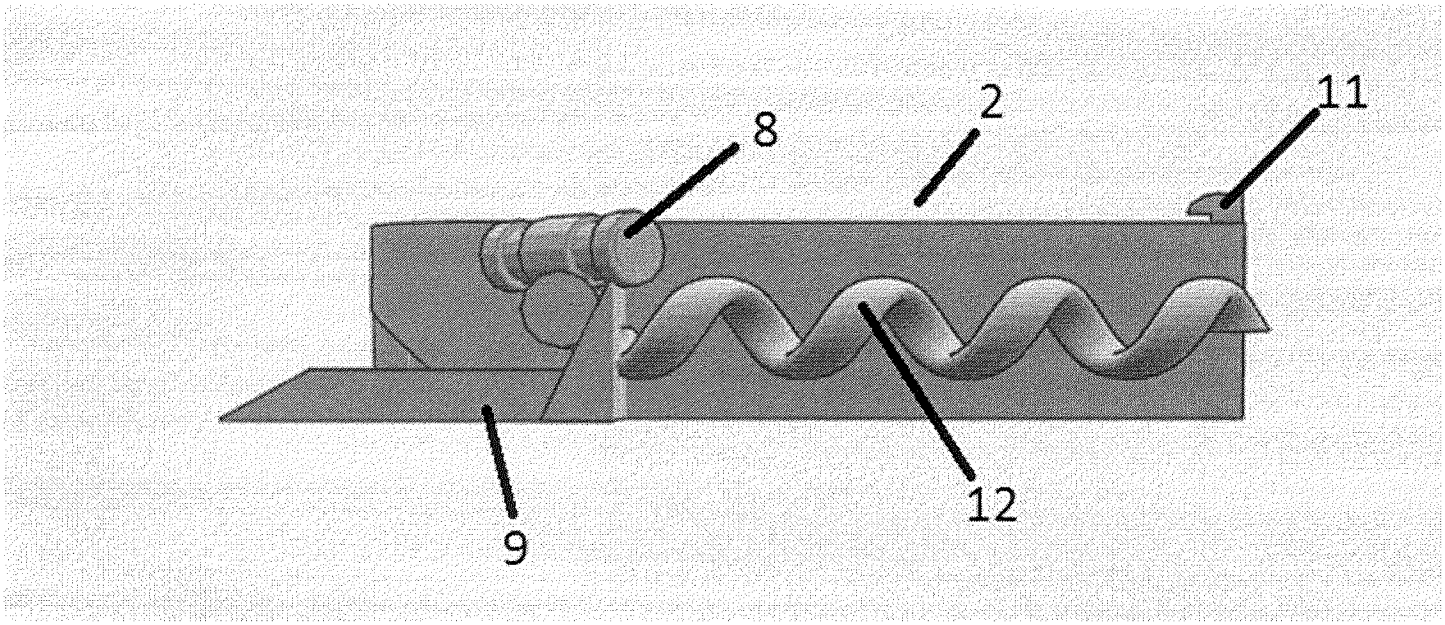
FIG. 5 is a left side view of an empty magazine.

FIG. 5 shows the magazine emptied of cartridges with the pushers 8 in a stopped position and the floorplate 9 moved to its most extended position by the magazine spring 12 and extending into the frame to interact with the slide lock lever. This causes the slide to lock back when the magazine is empty, and the slide is moved to a back position either manually or due to firing.

Figure 6:
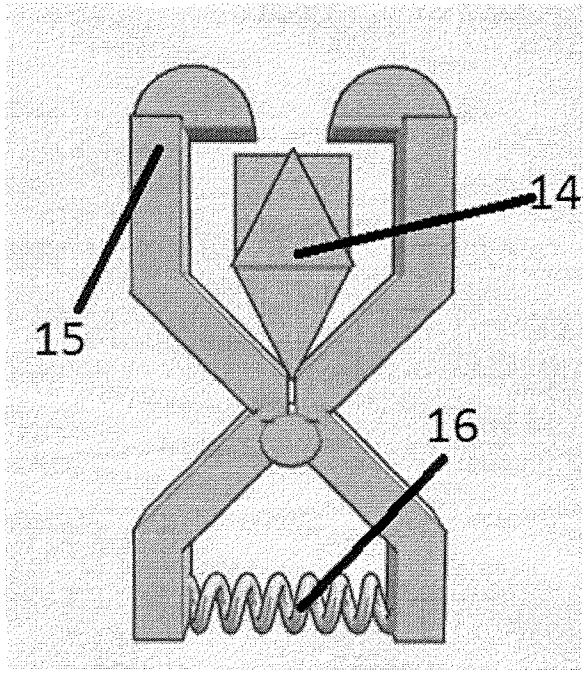
FIG. 6 is a side view of an embodiment showing the magazine lock mechanism.

The magazine also locks into place in a novel manner as depicted in the embodiment provided in FIG. 6, which shows the magazine lock that forms a pincer 15. This pincer is kept in a closed position by a spring 16 and is opened either by partially inserting a magazine or pressing the magazine release button on the frame which moves a wedge 14 to open the pincers and release the magazine if it is present.

Figure 7:
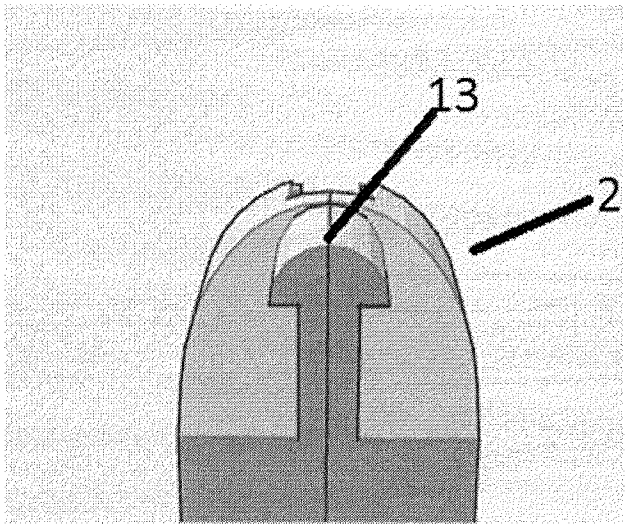
FIG. 7 is a view of an embodiment showing the slide stop of the device.

The magazine lock utilizes the magazine latch extension 13 located in the lower rear section of the magazine, beneath the internal helix as show in FIG. 7. This design is a unique, solid and robust magazine lock. This design is different from standard semiautomatic magazine well locks, which comprise notches in the magazines. The new design offers a stronger, more positive lock due to its solid structure giving greater support to the magazine locking mechanism as well as an ambidextrous magazine release.

Figure 8:
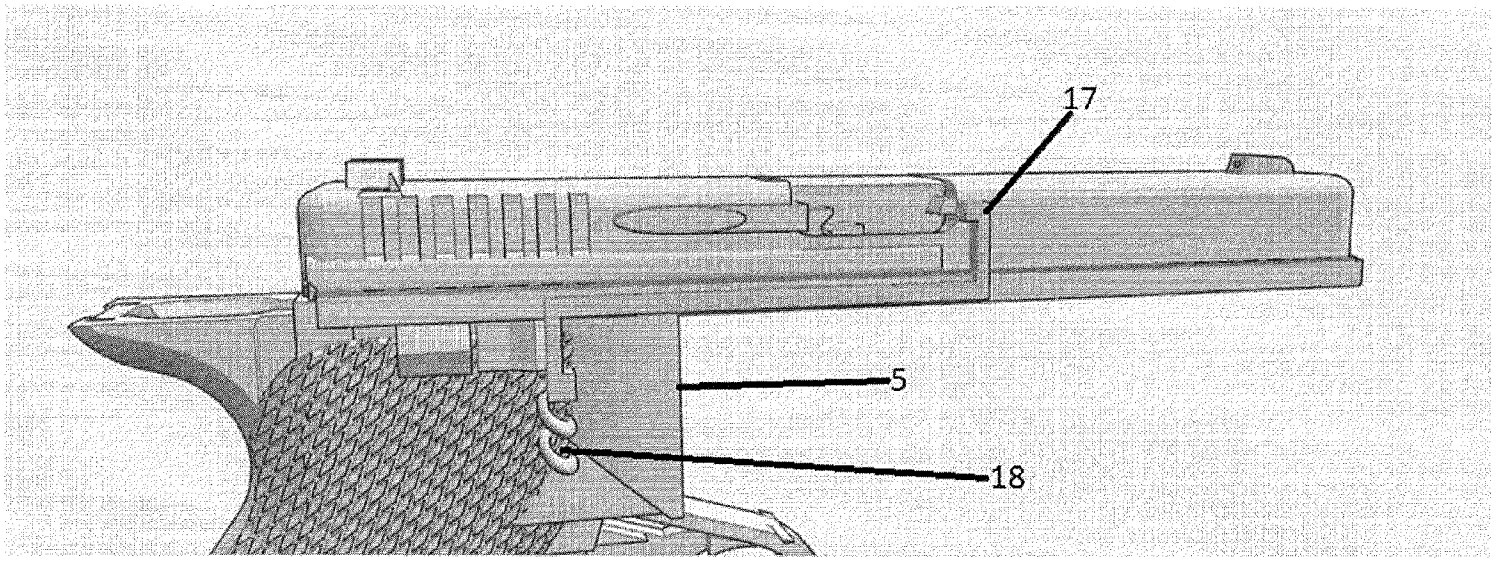
FIG. 8 is a side view of an embodiment showing the slide stop and attached springs.

FIG. 8 depicts an embodiment showing the slide stop 17 and attached spring 18 which keep the slide in place by halting its forward motion through contact of the barrel's 27 (FIG. 13) locking lugs 28 (FIG. 14) with the slide stop. The slide stop must be moved down during disassembly by the operator reaching into the frame and pulling it downward. The unique shape and positioning of the slide stop places the slide stop lever in the magazine well 5. The lever can only be manipulated by the operator when the magazine well is empty. In contrast to other semiautomatic handguns, this design cannot be disassembled or reassembled when a magazine is in the well.

Figure 9:
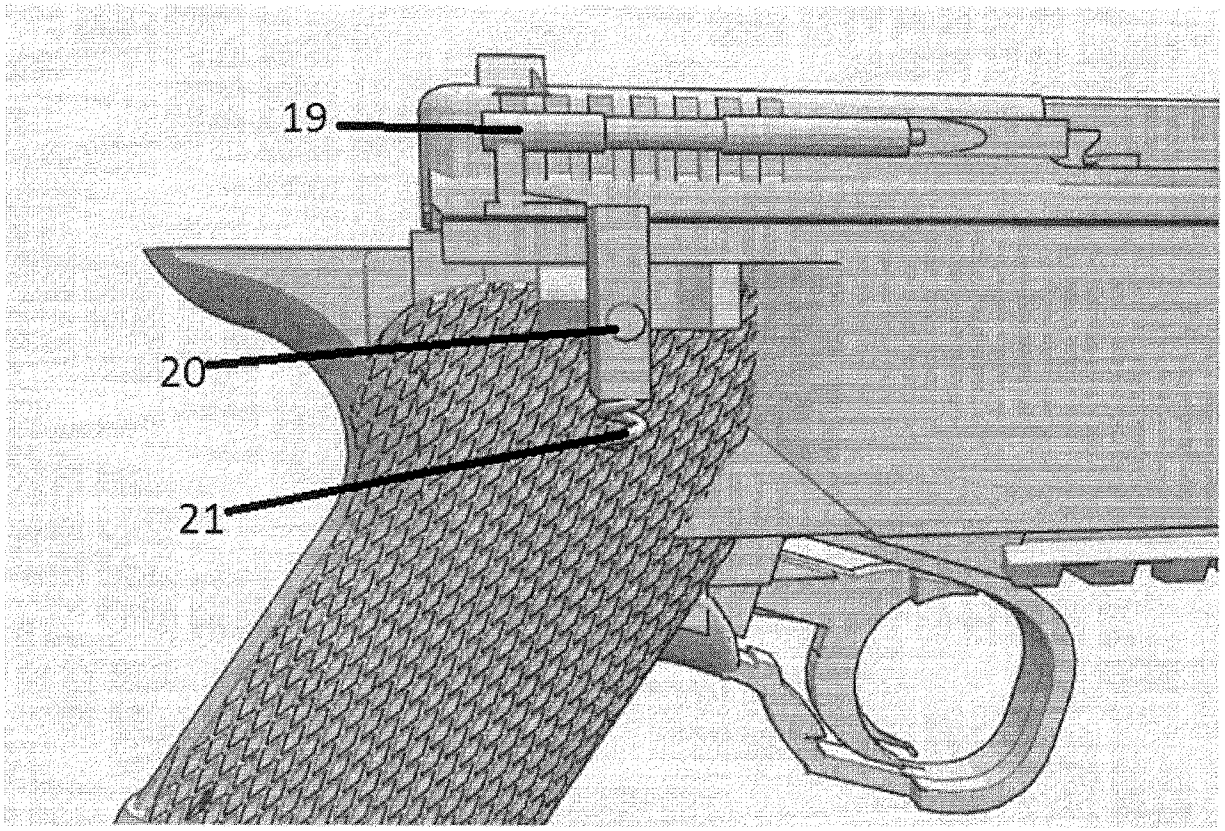
FIG. 9 is a side view of an embodiment showing the firing mechanism.

FIG. 9 shows the firing mechanism of the device. The trigger bar 22 (FIG. 10) has an extension which contacts the vertical connector 20 and causes compression of the vertical connector spring 21 when the trigger is pulled. The vertical connector is pushed upwards by the spring which keeps the striker 19 in a loaded position. When the trigger is pressed, the connector is moved downwards releasing the striker and firing the gun.

Figure 10:
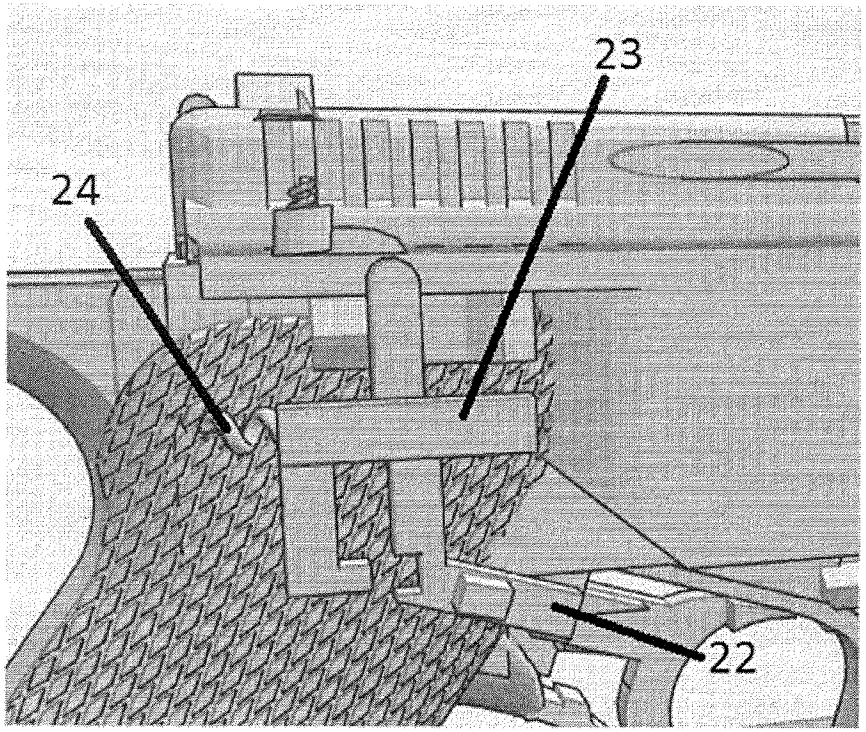
FIG. 10 is a side view of an embodiment showing the safeties of the gun.

FIG. 10 shows the internal safeties of the device, the unique safety being the magazine safety 23. If the magazine 2 is removed, as seen in FIG. 2, then the trigger bar 22 cannot release the striker and the firearm cannot be discharged due to the unique magazine disconnect safety shown. In contrast to other models which disengage the trigger from the firing mechanism, the magazine disconnect safety prevents the trigger bar from traveling far enough to release the striker. The position of the magazine disconnect safety aids in ejecting the magazine by the magazine disconnect safety spring, forcing the magazine out of the magazine well when released. Additionally, since the magazine disconnect safety blocks the trigger bar and must be depressed horizontally to disengage (as opposed to disengaging vertically or moving the firing mechanism out of position, as is standard), the magazine disconnect safety does not negatively affect the trigger's performance.

Figure 11:
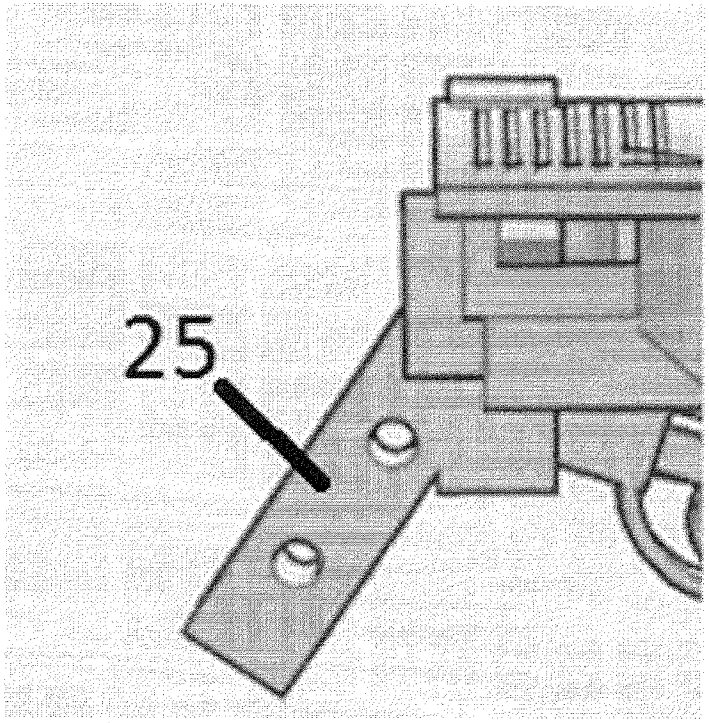
FIG. 11 is a side viewing showing an embodiment with the tang exposed without the grip.

FIG. 11 depicts an embodiment showing the tang 25 of the firearms frame exposed and without a grip. This design allows a fully detachable grip which may or may not contain electronics. In some embodiments, the grip may contain power sources such as batteries. Additionally, the grips are much more customizable compared to standard models due to not having to be integral to the magazine well.

Figure 12:
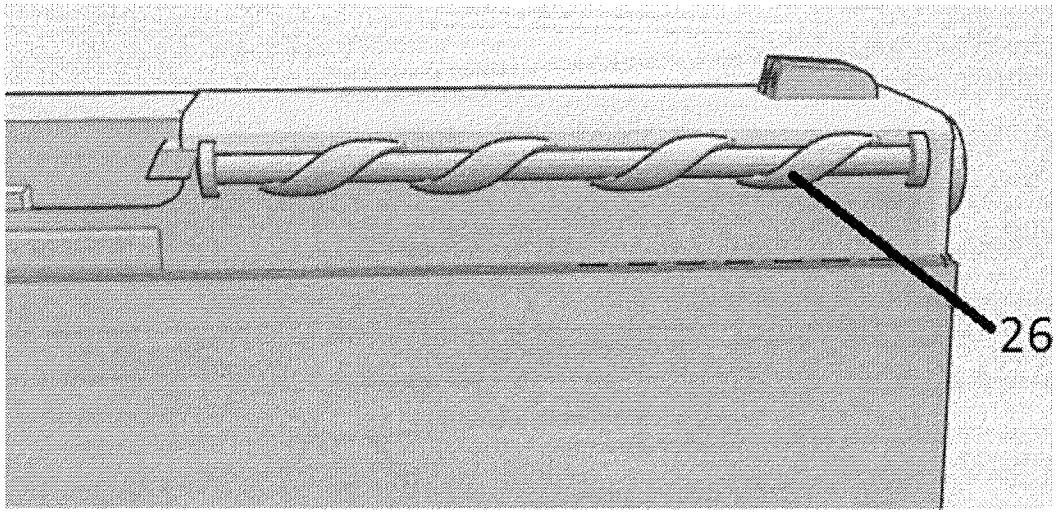
FIG. 12 is a side viewing of an embodiment showing one of the pistol's guide rods.
Figure 13:
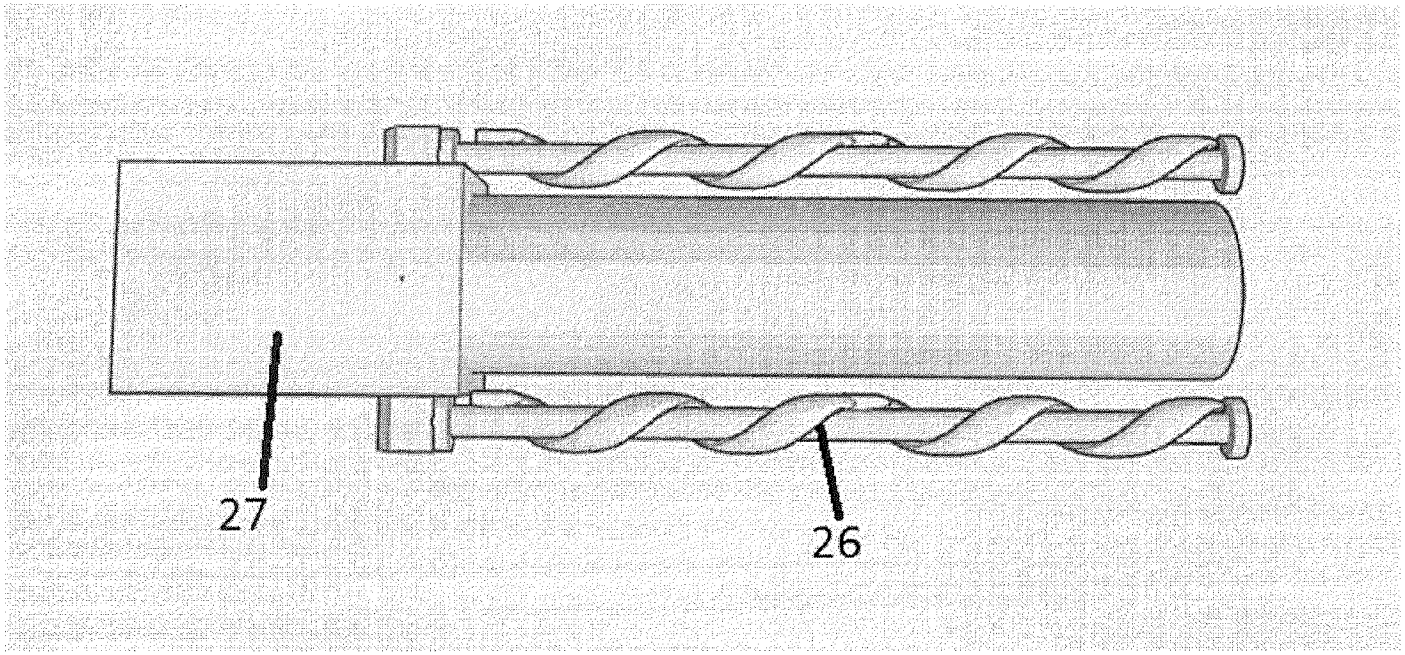
FIG. 13 is a top view of an embodiment showing the pistol's guide rods.

FIGS. 12 and 13 show the guide rods 26 of the firearm. These guide rods are located on either side of the barrel 27, as opposed to the usual position of a single guide rode located under the barrel. This allows room for the unique magazine and magazine well.

Figure 14:
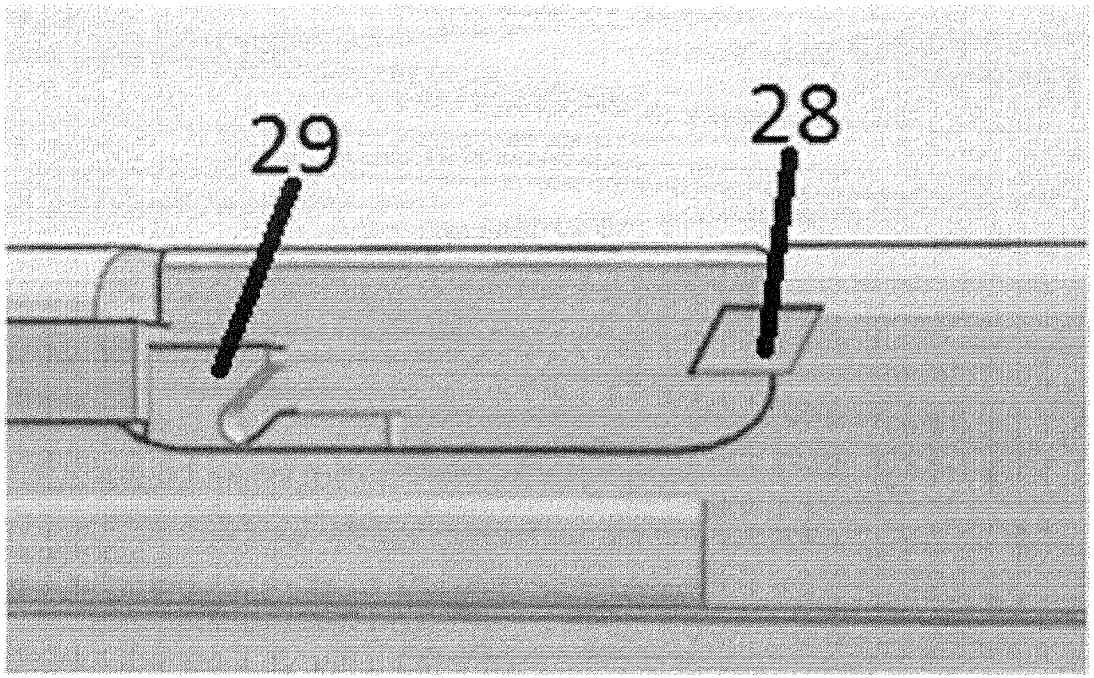
FIG. 14 is a side view of an embodiment showing the locking lugs on the barrel and the locking block on the frame.

FIG. 14 shows the locking lugs 28 and the locking blocks 29 which both correspond to the unique design of the barrel. Two locking lugs are in a 'winged' design which interact with appropriately situated and shaped locking blocks placed in the frame. The blocks are in two sections and form hook shapes which guides the barrel in a tilting motion as the gun cycles. Since they are comprised of two sections and interact with the uniquely shaped locking lug on the barrel, they can be constructed much more solidly than standard designs.

Figure 15:
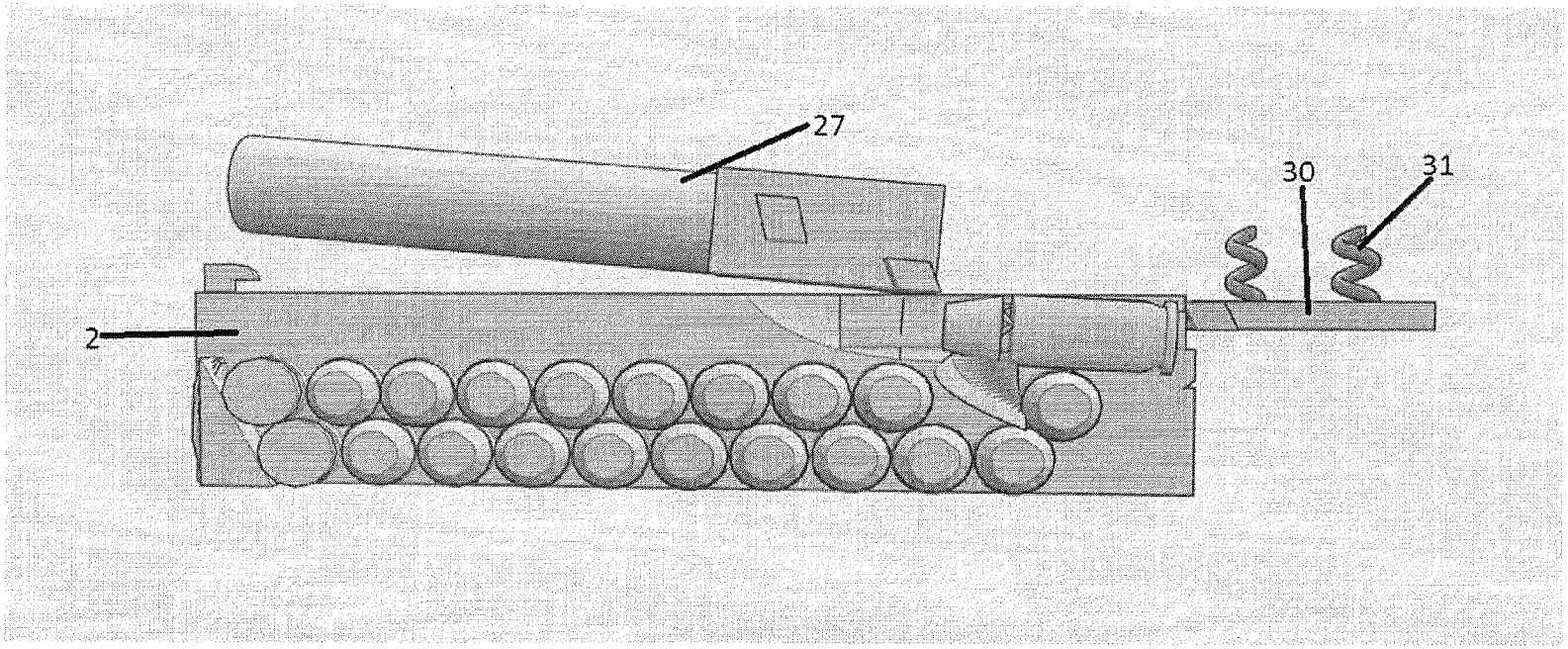
FIG. 15 is a side view of an embodiment showing the stripper rail in the upward position when the slide is in battery.
Figure 16:
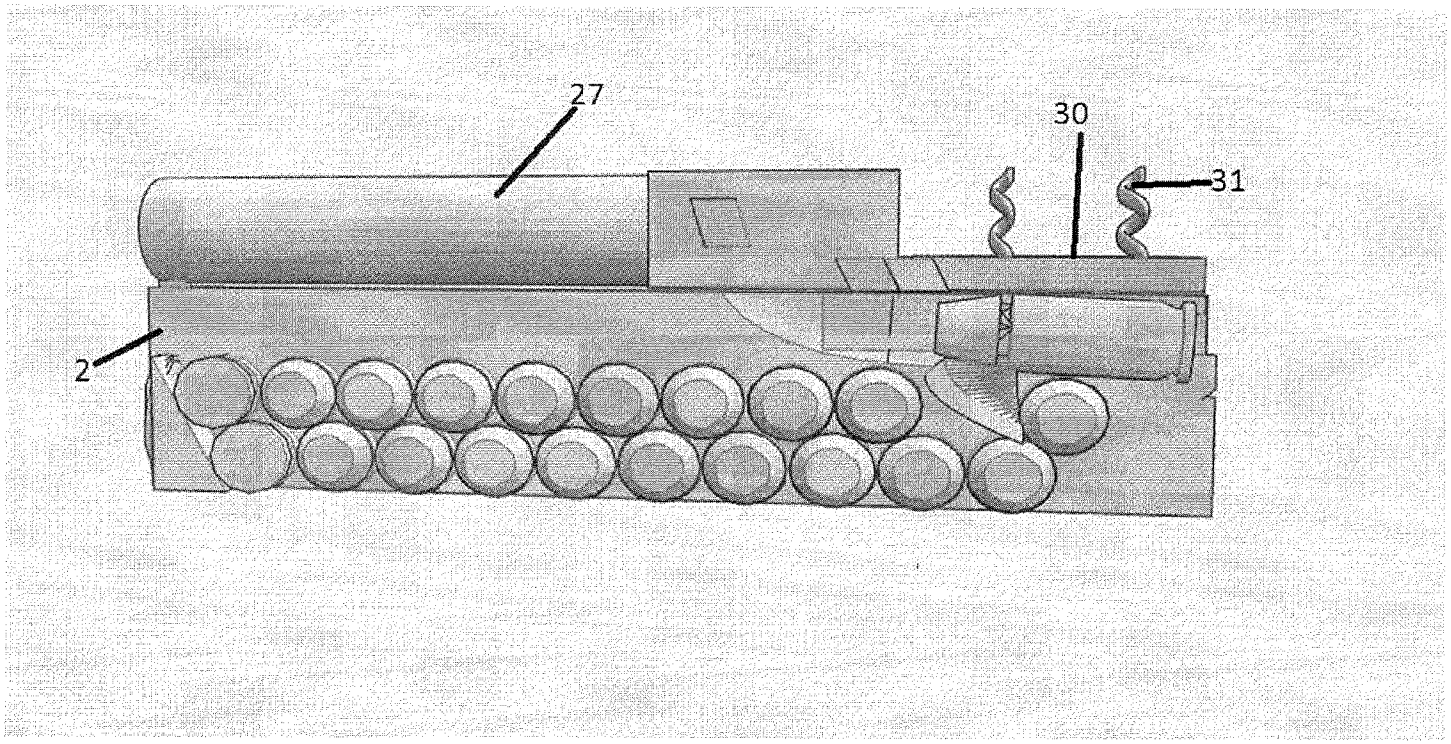
FIG. 16 is a side view of an embodiment showing the stripper rail in a downward position when the slide is racked back.

FIGS. 15 and 16 depict embodiments showing the stripper rail 30 in the up and down position respectively, because the magazine is placed horizontally, not vertically. The stripper rail needs to move up and down as the gun cycles so that it may interact with the cartridge but not interfere with the magazine. This is accomplished by springs 31 pushing the stripper rail 30 into a downward position when the gun is out of battery and extensions on both the stripper rail 30 and the barrel forcing the stripper rail 30 into an up position when the gun is in battery.

To summarize some of the unique aspects of the invention, the horizontally placed magazine 2 utilizes a helix 7 to turn the cartridge 10 into the position for feeding as well as a set of hooks 11 that interact with the frame to increase support. A solid magazine lock 13 may be used to engage the pincer shaped magazine release mechanism 16 located beneath the mouth of the magazine. This pincer shape is urged open by the movement of a wedge 14 or the insertion of a magazine into the magazine well 5. This is a much stronger design than the standard notches in the magazines. The magazine well 5 is largely open and includes a small crescent shaped opening near the trigger and below the slide. This position allows greater magazine capacity as well as moving the balance of the firearm forward, which reduces felt recoil and increases tactile awareness of the muzzle direction. The open nature of the magazine well 5, combined with the crescent shape, allows much easier and more instinctive reloading than a standard magazine well. This is because the crescent shape will naturally move the magazine into the proper position if it is within the crescent. Because there is no magazine well in place in the grip 4, the grip is fully customizable and interchangeable. The grip may optionally include a battery well or integrated electronics.

The position of the magazine 2 and magazine well 5 allow the addition of a unique type of magazine disconnect safety 23 which blocks the travel of the trigger bar 22 when the magazine 2 is absent. The horizontal nature of the safety means it also aids in the ejection of the magazine, which discourages the removal of the safety. The fact that it blocks the firing mechanism, as opposed to moving the firing mechanism to a disengaged position, means that it does not negatively affect the trigger, a common complaint about such safeties.

The barrel 27 is also unique as it utilizes two locking lugs 28, located on either side of the barrel, instead of the usual single lug located beneath the barrel. These interact with the uniquely shaped locking blocks 29 attached to the frame. This design places two guide rods 26 and recoil springs on either side of the barrel and lowers the bore of the firearm, thus decreasing felt recoil and aiding in feeding from the unique magazine. Because the magazine will not push cartridges upwards when the slide is to the rear (as on standard automatics), a sliding stripper rail 30, which moves cartridges into the barrel and is itself moved by contact with the barrel in the cycling process, is utilized. Due to the lack of upwards pressure and greater contact between the stripper rail and the cartridge, the chance of a malfunction is reduced.

The magazine's position and the barrel design allow the slide stop 17 to be completely shrouded by the frame and magazine, when the magazine is in place. Because of the magazine's position, it is impossible to manipulate the slide stop 17 when a magazine is in place. This is an additional feature that makes the firearm safer than other designs, especially during disassembly and reassembly of the firearm. Since there is no need for a lever or other device made to manipulate the slide stop 17 on the side of the firearm, this also decreases the overall width of the device due to the position of the slide lock lever.

To use the firearm 1, the operator first loads the magazine 2 with cartridges 10. This magazine 2 has innovations such as the following: the helix 7, which turns the cartridge 10 to the loading position, and the pushers 8, which move the cartridges through the helix 7 and which stop beneath the mouth of the magazine when the last catridge is removed from the magazine.

The magazine 2 is automatically locked into place once seated in the magazine well 5 and is removed by using the magazine release button.

Next the operator pulls the slide 6 backwards and releases it to chamber a cartridge 10. The trigger is then pulled, which causes a cartridge 10 to be struck by the striker 19 and a round to be fired due to the trigger bar 22 that compresses the firing mechanism's vertical connector 20. The movement of this piece backwards causes the vertical connector 20 to release the striker 19. The striker 19 in turn strikes the cartridge 10, discharging a round. The recoil of this action causes the slide 6 to cycle backwards.

When the slide 6 is either pulled back by hand or cycled backwards by recoil, the sliding stripper rail 30 is moved into a down position. The slide disconnect safety is also engaged. This safety includes the trigger bar and an indentation in the slide. When the slide moves backwards, it pushes the trigger bar 22, which pivots in the trigger down and out of contact with the vertical connector 20, which is pressed down by the striker 19 during rearward travel in a loaded position, ready to be fired again. Any cartridge 10 or spent brass in the chamber is also extracted by the extractor during the backwards motion of the slide.

When a magazine 2 is empty, the floorplate 9 extends into the frame to engage the slide lock, locking the slide 6 in a back position.

The slide 6 may be released from the locked position by the operator manually manipulating the slide lock lever, releasing it from a pulled back position when no magazine 2 or a loaded magazine is in the magazine well 5. The sliding stripper rail 30 sweeps the cartridge 10 into the chamber of the barrel 27 and is moved into an up position. Once the slide 6 is the forward position, the slide disconnect safety is no longer engaged but the trigger bar 22 is not in place to move the vertical connector. If the trigger was held back during the cycling process, as proper technique dictates, then the trigger must be 'reset' by allowing it to move forward until the trigger bar 22 reengages the vertical connector 20. If the trigger was not held back during the cycling process, it was, by necessity, forward and thus the trigger bar 22 is ready to engage the vertical connector, as when the firearm is first picked up when a round is chambered.

When a cartridge 10 is fired and there are no more cartridges left in the magazine 2, the slide 6 is locked back due to the floor plate extension 9 extending into the frame. This activates the slide lock which puts upward pressures on the slide lock. This pressure moves the slide lock into an upward position when the notch cut into the slide is moved over the slide lock by the slide's travel to the rear of the firearm. From here the slide lock lever must be used to release the slide 6, or the pressure must be alleviated, either by removing the empty magazine and leaving the magazine well 5 empty or by inserting a magazine 2 with one or more cartridges 10 loaded. Additionally, the slide 6 must be pulled backwards to disengage the slide lock.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCED COMPONENETS

Component 1: firearm or pistol in an assembled state
Component 2: magazine
Component 3: detachable accessory rail
Component 4: detachable grip
Component 5: magazine well
Component 6: firearm slide
Component 7: floor magazine helix
Component 8: cartridge pusher inside the magazine
Component 9: floorplate
Component 10: cartridge
Component 11: front magazine hook
Component 12: magazine spring
Component 13: magazine latch extension
Component 14: magazine latch opening wedge
Component 15: magazine latch pincer
Component 16: magazine latch spring
Component 17: magazine slide stop
Component 18: magazine slide stop spring
Component 19: firearm striker
Component 20: firing mechanism vertical connector
Component 21: vertical connector spring
Component 22: trigger bar
Component 23: magazine disconnect safety
Component 24: magazine disconnect safety spring
Component 25: tang of the firearm
Component 26: guide rods of the firearm
Component 27: barrel of the firearm
Component 28: firearm's locking lugs
Component 29: firearm's locking blocks
Component 30: sliding stripper rail
Component 31: sliding stripper rail springs

What is claimed is:

1. A pistol comprising: a barrel, a grip, a magazine well, and a magazine, wherein the magazine well is configured to engage with the magazine and is located adjacent to, beneath, and substantially parallel to the barrel, and the magazine well and the magazine are located in front of the grip.

2. The pistol of claim 1, wherein the pistol is a striker fired pistol.

3. The pistol of claim 1, wherein the magazine is substantially parallel to the barrel.

4. The pistol of claim 1, wherein the grip is detachable.

5. The pistol of claim 1 further comprising a tang configured to engage with the grip.

6. The pistol of claim 1 further comprising a slide assembly, wherein the magazine comprises an internal helix to turn a cartridge located within the magazine ninety degrees.

7. The pistol of claim 1 wherein the grip comprises a battery well.

8. The pistol of claim 1 wherein the grip comprises integrated electronics.

9. The pistol of claim 1 further comprising a pincer which locks the magazine into place.

10. A pistol comprising:

a. a frame;

b. a barrel mounted on the frame;

c. a grip connected to the frame;

d. a magazine well occupying a space within the frame; and e. a magazine, wherein the magazine well is configured to engage with the magazine and is located adjacent to, beneath, and substantially parallel to the barrel, and wherein the magazine well and the magazine are located in front of the grip.

11. The pistol of claim 10 wherein the pistol is a striker fired pistol.

12. The pistol of claim 10, wherein the magazine is substantially parallel to the barrel.

13. The pistol of claim 10, wherein the grip is detachable.

14. The pistol of claim 10 further comprising a tang connected to the frame and configured to engage with the grip.

15. The pistol of claim 10, wherein the magazine is attached to the front of the frame by at least two hooks on the front of the magazine which engage with indents in the front of the pistol.

16. The pistol of claim 10, wherein the grip comprises a battery well.

17. The pistol of claim 10, wherein the grip comprises integrated electronics.

18. The pistol of claim 10, further comprising a pincer which locks the magazine into place.

19. The pistol of claim 1, wherein the magazine well is open and oriented horizontally.

20. The pistol of claim 10, wherein the magazine comprises one or more hooks to engage with the frame.

21. The pistol of claim 10 further comprising two locking lugs, each locking lug located on a separate side of the barrel.

22. The pistol of claim 21 further comprising two locking blocks attached to the frame, each of the two locking blocks configured to interact with each of the two locking lugs.

23. The pistol of claim 10 further comprising a moving stripper rail.

* * * * *